US008411894B2

(12) United States Patent
Opitz

(10) Patent No.: US 8,411,894 B2
(45) Date of Patent: Apr. 2, 2013

(54) TRANSDUCER WITH DEFORMABLE CORNER

(75) Inventor: Martin Opitz, Vienna (AT)

(73) Assignee: AKG Acoustrics GmbH, Vienna (AT)

( * ) Notice: Subject to any disclaimer, the term of this patent is extended or adjusted under 35 U.S.C. 154(b) by 354 days.

(21) Appl. No.: 12/760,243

(22) Filed: Apr. 14, 2010

(65) Prior Publication Data

US 2010/0195862 A1 Aug. 5, 2010

Related U.S. Application Data

(63) Continuation of application No. 10/939,298, filed on Sep. 10, 2004, now Pat. No. 7,711,137.

(30) Foreign Application Priority Data

Sep. 11, 2003 (EP) ..... 03450204

(51) Int. Cl.
*H04R 25/00* (2006.01)

(52) U.S. Cl. ..... 381/398; 381/423; 381/424

(58) Field of Classification Search ..... 381/152, 381/423–426, 431–432
See application file for complete search history.

(56) References Cited

U.S. PATENT DOCUMENTS

| | | | |
|---|---|---|---|
| 3,612,783 | A | 10/1971 | Schneider et al. |
| 3,780,232 | A | 12/1973 | Ward |
| 3,834,486 | A | 9/1974 | Tsuge et al. |
| 3,858,680 | A | 1/1975 | Tsuge et al. |
| 3,946,832 | A | 3/1976 | Takano et al. |
| 3,997,023 | A | 12/1976 | White |
| 4,122,314 | A | 10/1978 | Matsuda et al. |
| 4,140,203 | A | 2/1979 | Niguchi et al. |
| 4,319,098 | A | 3/1982 | Baitcher |
| 4,478,309 | A | 10/1984 | Kawamura et al. |
| 4,554,414 | A | 11/1985 | House |
| 5,008,945 | A | 4/1991 | Murayama et al. |
| 5,319,718 | A | 6/1994 | Yocum |
| 5,734,734 | A | 3/1998 | Proni |
| 5,949,898 | A | 9/1999 | Proni |
| 6,026,929 | A | 2/2000 | Faraone |
| 6,111,969 | A | 8/2000 | Babb |
| 6,185,809 | B1 | 2/2001 | Pavlovic |
| D442,166 | S | 5/2001 | Schmidt |
| 6,351,543 | B1 | 2/2002 | Lenhard-Backhaus et al. |
| 6,510,231 | B2 | 1/2003 | Barnert |
| 6,587,570 | B1 | 7/2003 | Pavlovic |
| 6,622,820 | B2 | 9/2003 | Pavlovic |

(Continued)

FOREIGN PATENT DOCUMENTS

| | | | |
|---|---|---|---|
| EP | 1515582 | A1 | 3/2005 |
| EP | 1694094 | A1 | 8/2006 |

(Continued)

OTHER PUBLICATIONS

The Ultimate Binaural Experience; AKG Acoustics GmbH; A Harman International Company; Vienna/Austria; Jan. 2004.

(Continued)

*Primary Examiner* — Suhan Ni
(74) *Attorney, Agent, or Firm* — O'Shea Getz P.C.

(57) ABSTRACT

A transducer generates acoustic energy. The transducer is suitable for incorporation into any device that needs sound reproduction capability, including devices with generally rectangular geometries such as cell phones, PDAs, and portable gaming devices. The transducer includes a displaceable membrane with a deformable corner. The deformable corner may extend the frequency range over which the transducer generates acoustic energy without distortion. The deformable corner may be part of a membrane periphery around the displaceable membrane. The membrane periphery may be square, triangular, or may take any other polygonal shape.

20 Claims, 5 Drawing Sheets

U.S. PATENT DOCUMENTS

| | | | |
|---|---|---|---|
| 6,629,991 | B1 | 10/2003 | Lehdorfer |
| D481,709 | S | 11/2003 | Solderits |
| 6,668,066 | B2 | 12/2003 | Pribyl |
| 6,724,910 | B1 | 4/2004 | Heed et al. |
| 7,711,137 | B2 | 5/2010 | Opitz |
| 2003/0219141 | A1 | 11/2003 | Sugata et al. |

FOREIGN PATENT DOCUMENTS

| | | | |
|---|---|---|---|
| JP | 59094995 | A2 | 5/1984 |
| JP | 61121690 | A | 6/1986 |
| JP | 61123390 | A | 6/1986 |
| JP | 62265894 | A | 11/1987 |
| JP | 11205895 | A | 7/1999 |
| WO | WO 2006/087202 | A1 | 8/2006 |

OTHER PUBLICATIONS

AKG Acoustics K 1000 Service Guide; AKG Acoustics GmbH; Wien, Austraia; Nov. 1990.

AKG Acoustics K1000 Instruction Manual; introduction by Dr. Carl Poldy; undated.

TRANSDUCER WITH DEFORMABLE CORNER

CROSS-REFERENCE TO RELATED APPLICATIONS

This application is a continuation of U.S. application Ser. No. 10/939,298, filed on Sep. 10, 2004, titled TRANSDUCER WITH DEFORMABLE CORNER, which claims priority to European Patent Application No. 03450204.7, filed on Sep. 11, 2003, titled DYNAMIC CONVERTER, ESPECIALLY SMALL SPEAKER, all of which are incorporated by reference in this application in their entirety.

BACKGROUND OF THE INVENTION

1. Technical Field

This invention relates to a transducer, and more particularly to a transducer that dynamically converts electrical energy to acoustic energy.

2. Related Art

Audio speakers act as transducers that convert electrical energy in an audio signal to acoustic energy. Small audio speakers may be incorporated into mobile telephones, speaker phones, personal data assistants, and other devices. In some applications, these audio speakers need to adhere to a form factor meeting the generally rectangular shape of the device in which the audio speaker is installed.

Past rectangular audio speakers suffered from several drawbacks. Some designs omit the transducer membrane material at the corners. The omission of membrane material may form an acoustic short circuit that renders the audio speaker unable to accurately reproduce low frequencies.

In other designs, membrane material was rigidly attached at each corner. The resulting speaker suffered from membrane stiffening, with an accompanying increase in membrane resonance frequency. An audio speaker may produce nonlinear acoustic distortion effects at frequencies below the resonance frequency. Thus, some prior designs produced distorted sound over a wider range of frequencies.

A need exists for a transducer that overcomes some of these potential problems in the related art.

SUMMARY

This invention provides a transducer that may reproduce sound. The shape and size of the transducer may be selected to facilitate efficient incorporation of the transducer into a wide rage of devices such as portable music players and cellular phones. The transducer may provide enhanced sound reproduction for such devices across a wide range of frequencies.

The transducer may include a displaceable membrane with a deformable edge. The deformable edge may include a deformable corner structure and may form part of a membrane periphery around the displaceable membrane. The membrane periphery may be square, rectangular, or may take other shapes.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
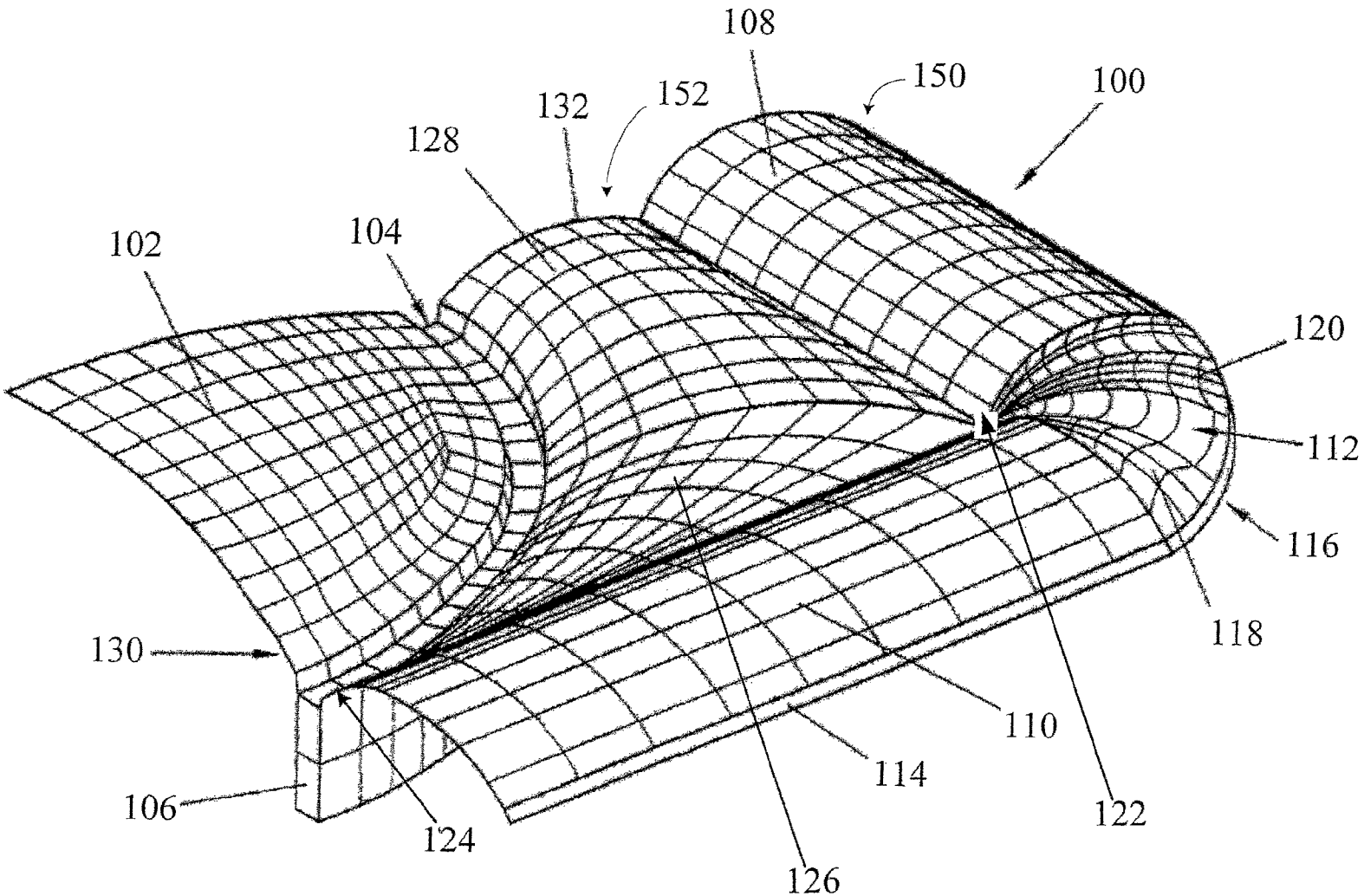
FIG. 1 is a transducer section.

In FIG. 1, a transducer section 100 is shown that is one quarter of a full rectangular transducer. The transducer 100 may include a displaceable structure such as the displaceable membrane 102. A groove or ring 104 may delineate the displaceable structure. The transducer 100 may also include a periphery 150 and an intermediate portion 152.

The displaceable membrane 102 may be near the center of the transducer 100 and may have a dome shape. The transducer 100 may employ other shapes at other locations. The periphery 150 may include one or more peripheral membrane structures, such as the edges 108 and 110 and the corner 112. The corners may be provided between peripheral membrane structures. In FIG. 1, the corner 112 is provided between the edges 108 and 110.

The intermediate portion 152 may extend between the displaceable membrane 102 and/or ring 104 and the periphery 150. The intermediate portion 152 may include one or more intermediate membranes such as the intermediate membranes 126 and 128. The intermediate membrane 128 extends between the edge 108 and the ring 104. The intermediate membrane 126 extends between the edge 110 and the ring 104.

A coil 106 may be coupled to the displaceable membrane 102. The coil 106 may be glued to the displaceable membrane 102. Alternatively, the coil 106 may be attached to the displaceable membrane 102 with a fastener, interference fit, clamp, or other coupling.

The coil 106 may carry signal current supplied by sound reproduction circuitry. The transducer 100 may be used in other capacities, however, and is not limited to the reproduction of sound. The interaction of the signal current in the coil 106 and a surrounding magnetic field may impart a reciprocating motion to the displaceable membrane 102 to produce acoustic energy. The displaceable membrane 102 may move like a rigid piston without deformation (i.e., in a "piston mode").

The displaceable membrane 102 may move and all or part of the periphery 150 and/or intermediate portion 152 may deform. The deformation may facilitate the motion of the displaceable membrane 102. The structure undergoing deformation may change in shape to accommodate the motion of the displaceable membrane 102, and may resiliently return to its original shape after deforming. For example, the corner 112 may expand and contract while the displaceable membrane 102 moves.

The periphery 150 extends around the displaceable membrane 102. The periphery 150 may include adhesive on all or part of any edge, such as the adhesive edge 114. The adhesive edge 114 may firmly secure the outer edge of the periphery 150 to another structure, such as a loudspeaker frame. The transducer may be secured in place in other manners, such as by a fastener, an interference fit, a clamp, or in other coupling.

The edges 108 and 110 may have the same or different thicknesses, widths, or cross sections. The edges 108 and 110 may have cross sectional curvature or may omit curvature. The curvature may give a membrane section a height between zero (i.e., flat) to half the membrane section width, or more. The curvature may be semicircular, elliptical, or otherwise curved.

The corner 112 may include an outer boundary 116. The outer boundary 116 may be curved or may include one or more curved or linear segments that may provide a transition between the edges 108 and 110. Any corner in the periphery 150 may provide a deformable portion for the periphery 150. One or more crests 118 and grooves 120 may implement the deformable portions. When deforming, the corners may expand and contract in a manner similar to that of a bellows or accordion.

The crests 118 may be peaks, apexes or other summits of membrane material. The grooves 120 may be depressions, valleys, hollows or other grooves of membrane material. Other shapes and structures, such as membrane folds, may impart deformable characteristics to the membrane material, however.

The crests 118 and grooves 120 may run perpendicularly to the periphery 150. For example, the crests 118 and grooves 120 may run perpendicularly to the boundary curvature of the corner 112. To that end, the crests 118 and grooves 120 and may extend radially from a center of curvature 122 of the corner 112.

Additional crests and grooves also may be provided. The additional crests and grooves may facilitate deformation of any portion of the membrane. In one implementation, the edges 108 or 110 include crests and grooves. The crests and grooves for the edges 108 or 110 may be provided in border regions 130 where the edges 108 or 110 meet the displaceable membrane 102 or ring 104.

One or more intermediate membranes may run along all or part of the periphery 150. For example, the intermediate membrane 128 may run along the side 132 of the periphery 150 between the ring 104 and the inner portion of the edge 108. An intermediate membrane may also taper away as it reaches a border region where the periphery 150 reaches, meets, joins, merges, or connects with the displaceable membrane 102 or ring 104. For example, the intermediate membrane 126 ends in the border region 130 where the ring 104 meets the edge 110. Multiple intermediate membranes may extend over any portion of space between the membrane periphery and the displaceable membrane 102 or ring 104.

The periphery 150 may be non-circular. As examples, the periphery 150 may have a regular polygonal shape, irregular polygonal shape, or other shape. As examples, the membrane periphery may have a square, rectangular, pentagonal, hexagonal, triangular or other shape. As additional examples, the membrane periphery may have a trapezoidal or isosceles triangular shape.

In implementations in which the periphery 150 is rectangular, the aspect ratio between the longer and shorter sides may vary widely. The aspect ratio may be between 1 and 2. In other implementations, the aspect ratio may be less than 1, or may be larger than 2, for example 2-5 or more.

Accordingly, the length and width of the periphery 150 may vary widely. The length of the longer rectangular edge may be between 7 mm and 70 mm, for example approximately 20 mm. The rectangular shape and size of the membrane periphery facilitates incorporation of the transducer into mobile telephones, personal data assistants (PDAs), portable gaming devices, portable multimedia players, and other devices that have a generally rectangular shape. The rectangular membrane shape also facilitates more efficient utilization of the interior space of the device.

The intermediate membranes 126 and 128 may have cross sectional curvature independent of the shape of the periphery 150. In implementations employing rectangular membrane peripheries, the intermediate membranes 126 and 128 may have a height between zero and one-half of the length of a side (e.g., the shorter side) of the membrane periphery. Greater heights may be employed. The intermediate membranes 126 and 128 may have circular, elliptical or other curvature that may vary along the length of the membranes 126 and 128. The intermediate membranes 126 and 128 may have the appearance of bulges or humps between the periphery 150 and the displaceable membrane 102.

The intermediate membranes 126 and 128 and the membrane sections 108 and 110 in the membrane periphery have thicknesses that may be formed as described in U.S. Pat. No. 6,185,809, for example. In one implementation, the ratio between the intermediate membrane thickness and the edge thickness is between 1 and 2, although other ratios may be employed. The transducer membrane material, thickness, and shape may be selected to establish a desired lower limit frequency as described in U.S. Pat. No. 6,185,809.

The intermediate membranes 126 and 128 and/or membrane sections 108 and 110 may be formed from macrofol, polycarbonate film, or other materials. Composites are also suitable, including polycarbonate with polyurethane film. The polyurethane film may influence mechanical dampening, while polycarbonate film may establish beneficial rigidity of the membrane. A mix of materials may also be used. For example, the membrane sections 108 and 110 may be formed from a composite, while the corners 112 may be polyurethane.

The periphery 150, including the edges 108 and 110 may act as a mechanical spring in a spring-mass system. The coil 106 and displaceable membrane 102 may form the mass in the spring-mass system. The intermediate membranes 126 and 128 may act as an additional spring in the spring-mass system in series with the periphery 150.

In other words, the edges 108 and 110 and the intermediate membranes 126 and 128 may interact as springs in series. When a static or harmonic force is applied through the coil 106, the displaceable membrane 102 undergoes displacement. In the case of a harmonic force, a frequency below the resonance frequency of the spring-mass system may be chosen to drive the displaceable membrane 102. Below the resonance frequency, the behavior of the spring-mass system is determined by the spring properties.

The spring properties may be established by setting the membrane thicknesses, variation in membrane thicknesses, membrane materials, radius of curvature of the membranes, or by setting other membrane properties. The properties influence the deformation behavior of the membranes. The deformation behavior may be established to impart increasing deformation from an edge of the membrane periphery toward the center of the transducer.

The thicknesses of the edges 108 and 110 and intermediate membranes 126 and 128 may influence the natural frequency of the spring-mass system. The thicknesses may vary depending on the desired natural frequency. In one implementation, the thickness of the edges and/or intermediate membranes 126 and 128 may be between approximately 15 um to 80 um. Larger thicknesses are also suitable and may be employed in larger transducers, to establish a higher natural frequency, or for other reasons.

Both the edges 108 and 110 of the periphery 150 and the intermediate membranes 126 and 128 may deform. Numerical simulation by a finite element program may guide the selection of membrane properties. Alternatively or additionally, an interferometer based imaging laser vibrometer may take measurements of actual implementation prototypes to provide feedback to tailor the membrane properties.

Any membrane may vary in thickness. The variation may be discontinuous or step-like, smooth and continuous, or both. The membranes may be fabricated to establish uniform distribution of deformations across the membranes, with attendant linearized mechanical compliance. Linearized mechanical compliance may reduce or minimize the non-linear distortion factor, intermodulation distortions, or other distortions.

The non-linear distortion factor may be influenced by the ratio between the intermediate membrane thickness and the membrane section thickness. For a given natural frequency, the ratio may be selected to reduce or minimize the non-linear distortion factor.

Figure 2:
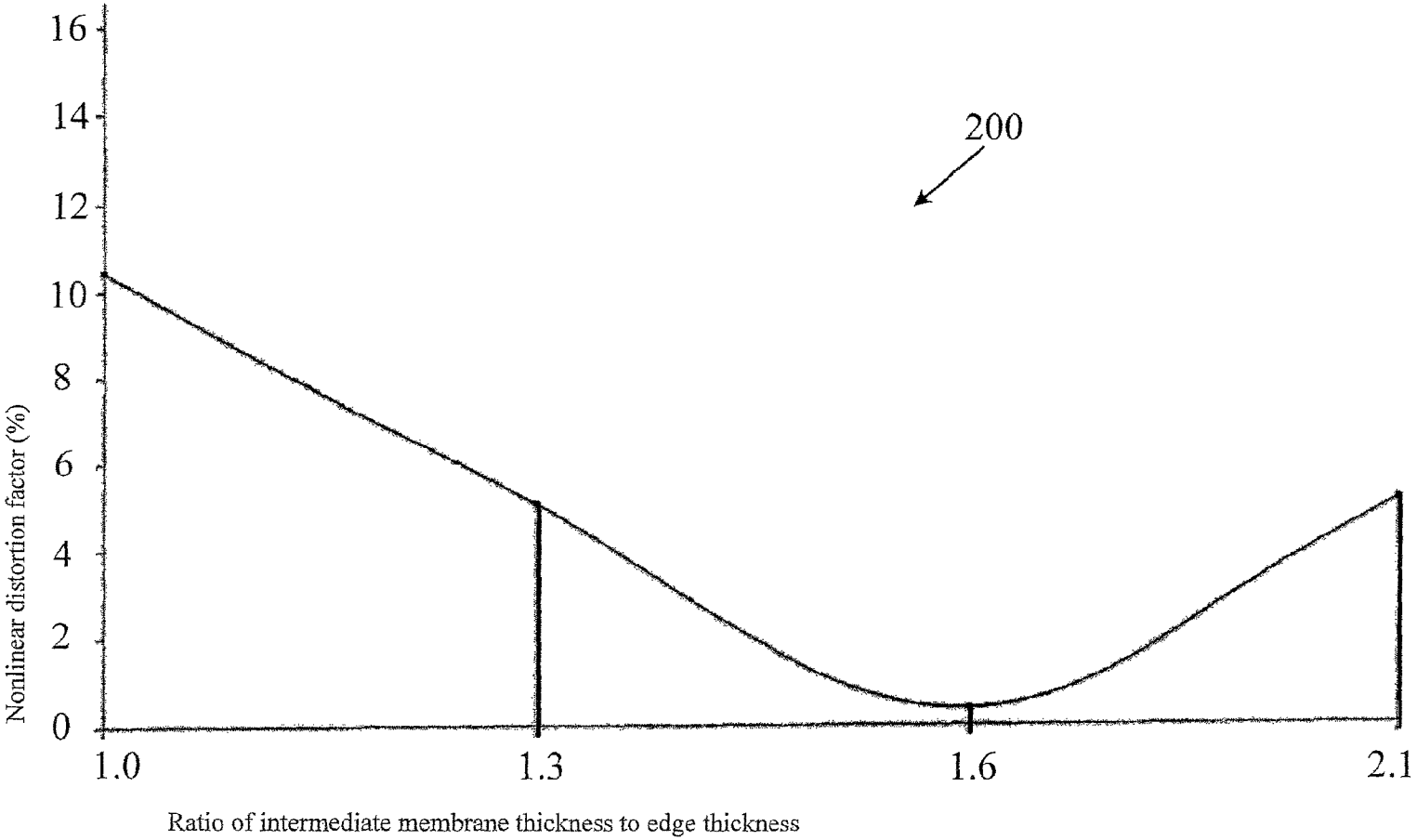
FIG. 2 shows a relationship between membrane thickness ratio and distortion.

In FIG. 2, a plot 200 shows the calculated non-linear distortion factor of a rectangular transducer at a pre-selected sound pressure. The calculated non-linear distortion factor is given as a function of the ratio between the intermediate membrane thickness and the edge thickness. The plot 200 shows a variation in ratio between 1.0 and 2.1. A minimum non-linear distortion is present at a ratio of 1.6.

Figure 3:
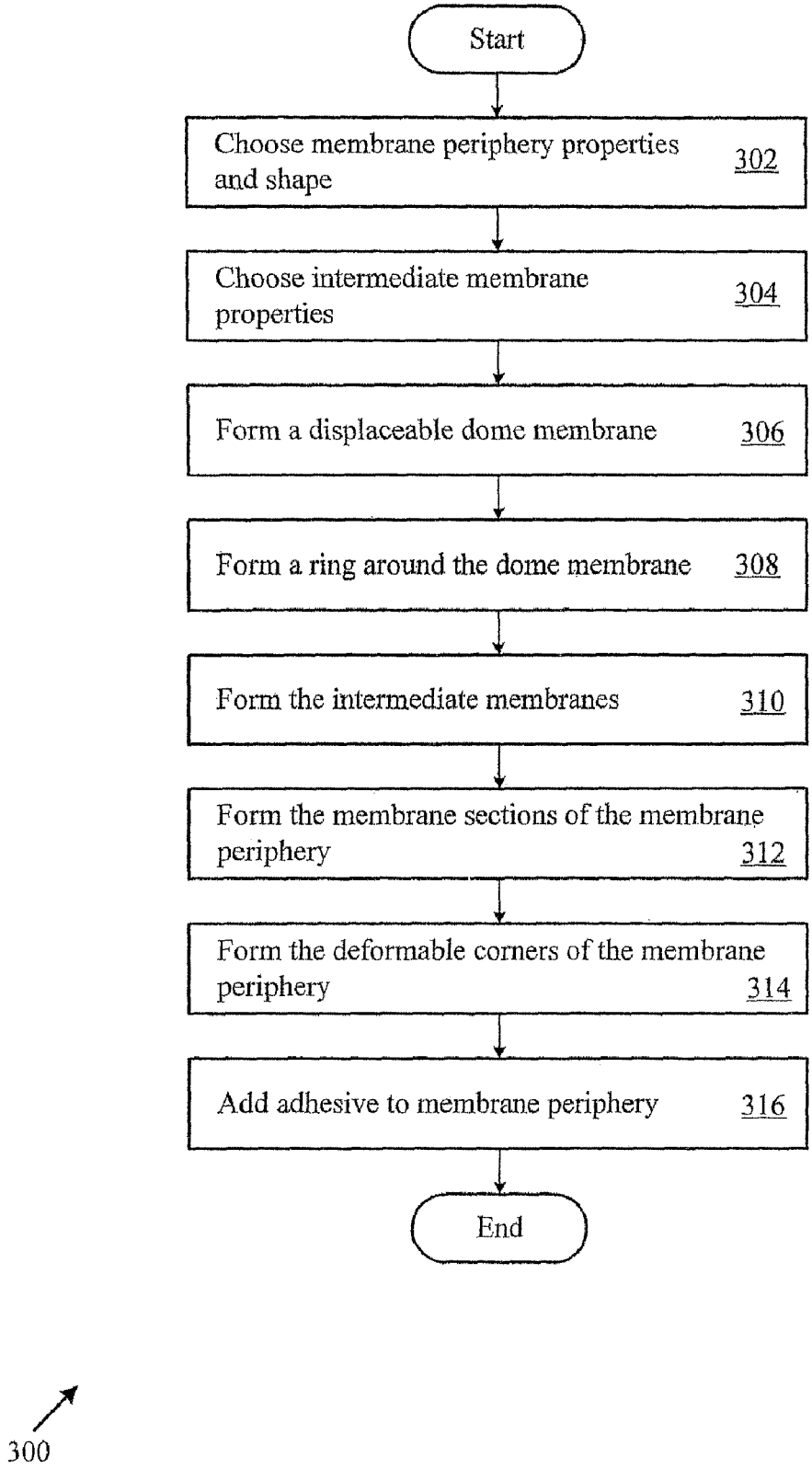
FIG. 3 is a flow diagram for fabricating a transducer.

In FIG. 3, a flow diagram illustrates a method 300 for making a transducer. The transducer 100 may be formed from a single sheet of membrane material using a heat-molding process. The transducer 100 may be formed in other manners, however.

The membrane periphery properties and shape are determined (Act 302). In addition, the intermediate membrane properties are determined (Act 304). The properties may include membrane material, thickness, variation in thickness, curvature, size, shape, or other properties for one or more of the corners 112, intermediate membranes 126 and 128, and/or membrane sections 108 and 110.

A displaceable membrane 102 is formed (Act 306). A ring 104 may also be formed around the displaceable membrane (Act 308). The displaceable membrane 102 may take the form of a dome or other shape. The displaceable membrane may be centrally located, or may be located in other positions.

The intermediate membranes 126 and 128 are formed around the displaceable membrane 102 (Act 310). Edges 108 and 110 are formed as part of the periphery 150 (Act 312). Additionally, one or more corners 112 may be formed in the periphery 150 (Act 314). Any portion of the intermediate membranes 126 and 128 and periphery 150, including the edges 108 and 110 and corners 112, may be deformable.

For example, the edge 110 may include a deformable edge section 124. The deformable edge section 124 may be formed with crests and grooves or other deformable structures. The deformable edge section 124 may be positioned at or near one or more of the border regions 130. Alternatively, the deformable edge sections may be located at other positions along the edges.

An adhesive may be added to the membrane periphery to provide an adhesive edge 114. The adhesive edge 114 may be facilitate installation of the transducer in a device employing sound reproduction circuitry. Other fasteners may be employed.

Figure 4:
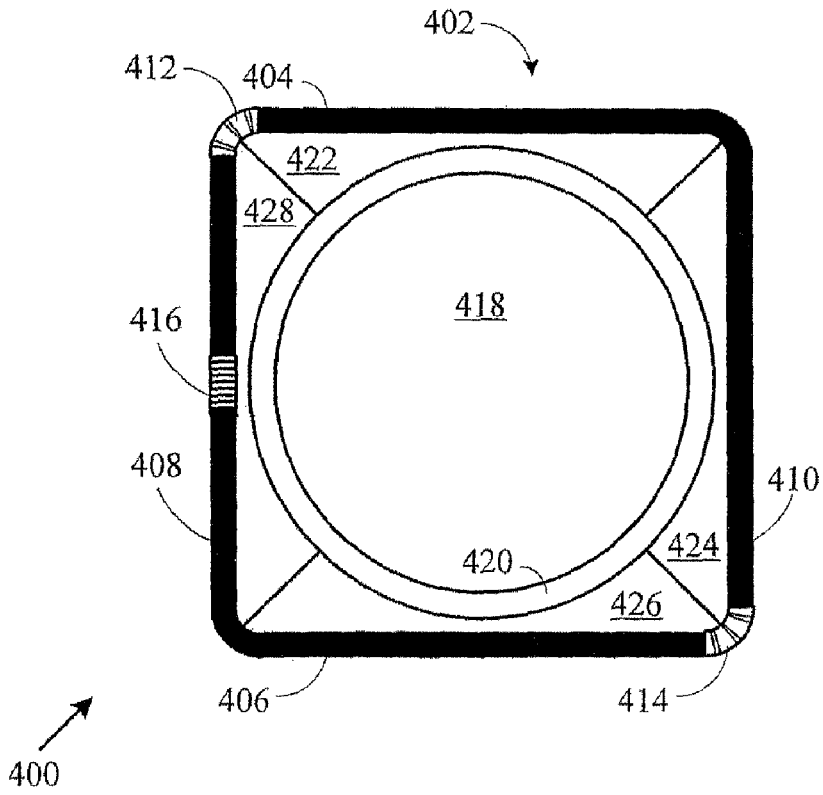
FIG. 4 shows a square transducer.

FIG. 4 shows a square transducer 400. The transducer 400 includes a periphery 402 with four edges 404, 406, 408, and 410. The edges are connected by corners, including two deformable corners 412 and 414. In addition, the edge 408 includes a deformable edge section 416. The transducer 400 also includes a displaceable membrane 418 surrounded by a ring 420. Intermediate membranes 422, 424, 426, and 428 extend between the ring 420 and the periphery 402.

The deformable edge section 416 may be formed with crests and grooves, membrane folds, or other deformable structures. The deformable edge section 416 may be positioned in the periphery 402 at or near where the edge 408 approaches the displaceable membrane 408 or ring 410. The transducer 400 may omit the deformable edge structure 416, or may include additional deformable edge structures in the same edge or in other edges.

Figure 5:
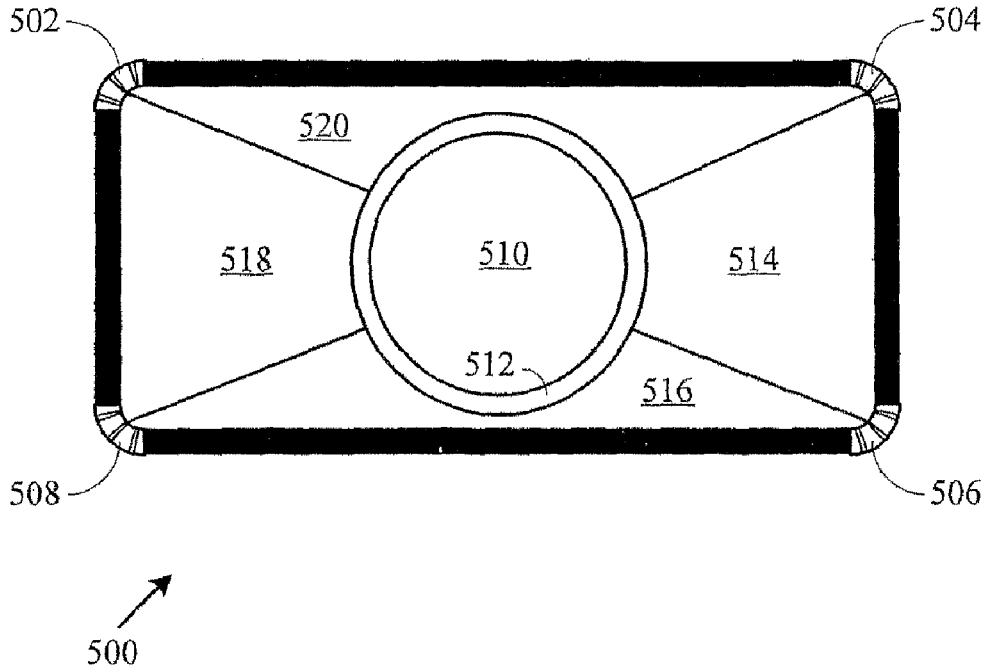
FIG. 5 shows a rectangular transducer.

FIG. 5 shows a rectangular transducer 500. The transducer 500 includes deformable corners 502, 504, 506, and 508 where the orthogonal edges would intersect if they were extended. The transducer 500 also includes a displaceable membrane 510, ring 512, and intermediate membranes 514, 516, 518, and 520.

Figure 6:
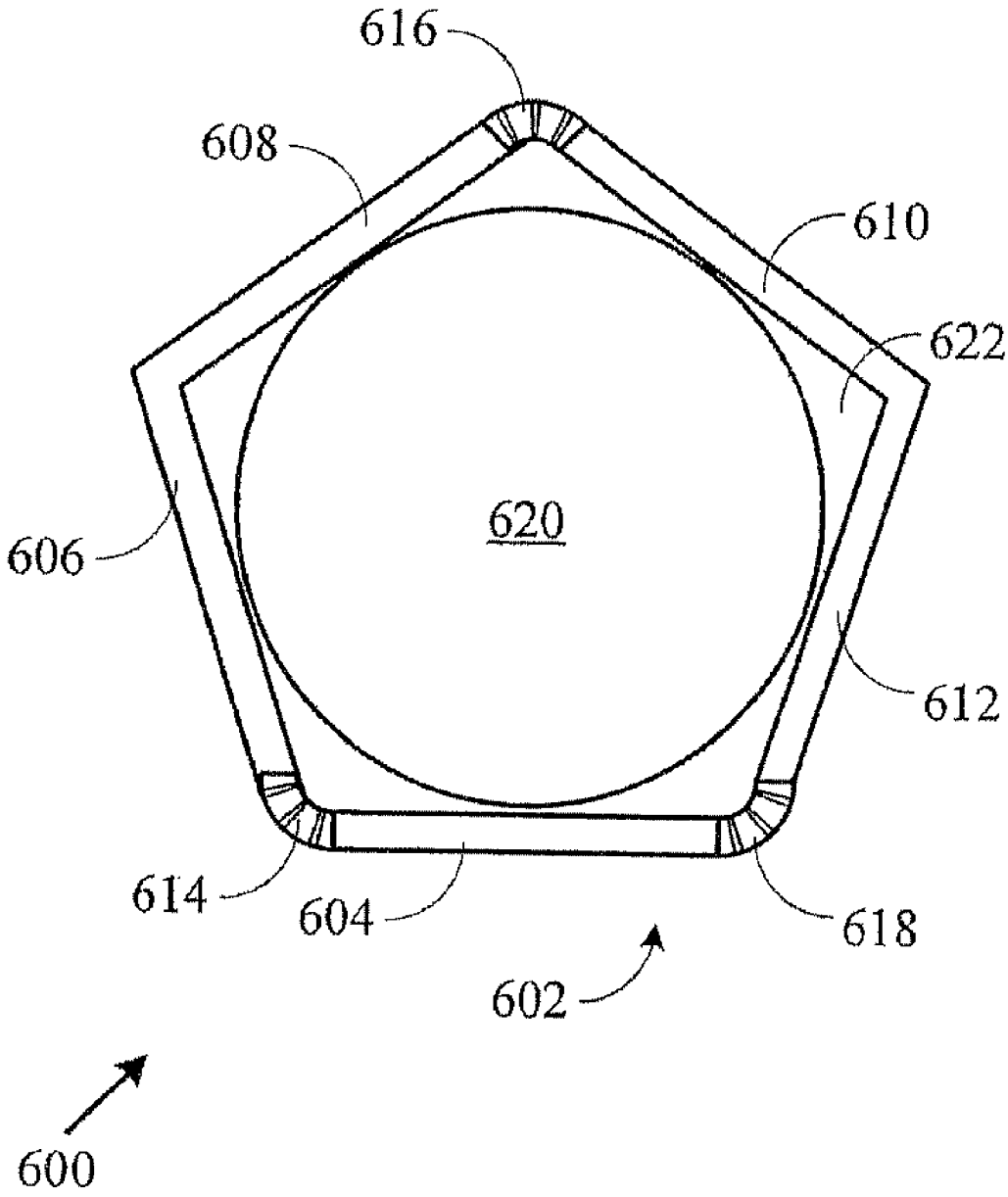
FIG. 6 shows a pentagonal transducer.

FIG. 6 shows a pentagonal transducer 600. The transducer 600 includes a periphery 602 with five edges 604, 606, 608, 610, and 612. A deformable corner 614 connects the edge 604 and the edge 606. A deformable corner 616 connects the edge 608 and the edge 610. A deformable corner 618 connects the edges 604 and 612.

The transducer 600 also includes a displaceable membrane 620. Between the displaceable membrane 620 and the edges may be one or more intermediate membranes. For example, the intermediate membrane 622 extends between the displaceable membrane 602 and the edges 620 and 612.

The transducer membranes close the non-circular area around the displaceable membrane 102. The transducer may provide enhanced low frequency operation by preventing acoustic short circuits that, due to the mechanical design of the transducer, severely attenuate low frequencies. In addition, the transducer provides deformable membrane structures that facilitate mechanical compliance of the transducer. The deformable structures may flex, unwind, expand, or contract in a manner similar to that of a bellows or accordion. The mechanical compliance facilitates a reduction in nonlinear acoustic distortion effects.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A transducer comprising:

a displaceable membrane;

a deformable corner coupled to the displaceable membrane, the membrane periphery comprising the deformable corner; and an intermediate membrane between the displaceable membrane and the deformable corner, and where the intermediate membrane has a first thickness, and at least a portion of the membrane periphery has a second thickness different than the first thickness.

2. The transducer of claim 1, where the deformable corner comprises a deformable curved corner.

3. The transducer of claim 1, where the membrane periphery has a varying thickness.

4. A transducer comprising;

a displaceable membrane;

a deformable corner; and an intermediate membrane between the displaceable membrane and the deformable corner;

where the displaceable membrane, the deformable corner, and the intermediate membrane are formed from a single sheet of membrane material.

5. The transducer of claim 4, where the deformable corner comprises a deformable curved corner.

6. The transducer of claim 4, where the deformable corner comprises a bellows structure.

7. The transducer of claim 4, where the deformable corner comprises multiple crests and depressions.

8. The transducer of claim 4, where intermediate membrane has a varying thickness.

9. The transducer of claim 4, where the displaceable membrane comprises a dome membrane.

10. The transducer of claim 4, further comprising a membrane periphery around the displaceable membrane, the membrane periphery comprising the deformable corner.

11. The transducer of claim 10, where the intermediate membrane has a first thickness, and at least a portion of the membrane periphery has a second thickness different than the first thickness.

12. The transducer of claim 10, where the membrane periphery has a varying thickness.

13. A transducer comprising:

a displaceable membrane; and a membrane periphery coupled to the displaceable membrane;

where the membrane periphery comprises a deformable corner comprising crests configured to facilitate deformation of a portion of the membrane periphery.

14. The transducer of claim 13, further comprising an intermediate membrane between the displaceable membrane and the deformable corner.

15. The transducer of claim 14, where the intermediate membrane section has a cross-sectional curvature.

16. The transducer of claim 13, where the membrane periphery has cross-sectional curvature.

17. The transducer of claim 13, where the membrane periphery is polygonal.

18. The transducer of claim 13, where the transducer is formed from a single sheet of membrane material.

19. The transducer of claim 14, where the transducer is formed from a single sheet of membrane material.

20. The transducer, of claim 14, where the intermediate membrane has a first thickness, and at least a portion of the membrane periphery has a second thickness different than the first thickness.

* * * * *

UNITED STATES PATENT AND TRADEMARK OFFICE

CERTIFICATE OF CORRECTION

PATENT NO. : 8,411,894 B2
APPLICATION NO. : 12/760243
DATED : April 2, 2013
INVENTOR(S) : Martin Opitz It is certified that error appears in the above-identified patent and that said Letters Patent is hereby corrected as shown below:

On the Title Page
Under Assignee, Item (73), please delete "Acoustrics" and insert --Acoustics--

Signed and Sealed this
Fourth Day of June, 2013

Teresa Stanek Rea
*Acting Director of the United States Patent and Trademark Office*